US005429476A

United States Patent [19]

Krauter et al.

[11] Patent Number: 5,429,476

[45] Date of Patent: Jul. 4, 1995

[54] FUEL PUMP

[75] Inventors: Lothar Krauter, Bietigheim-Bissingen; Michael Kuehn, Bietigheim; Michael Niederkofler, Remseck, all of Germany

[73] Assignee: Robert Bosch GmbH, Stuttgart, Germany

[21] Appl. No.: 277,898

[22] Filed: Jul. 20, 1994

Related U.S. Application Data

[63] Continuation of Ser. No. 136,686, Oct. 14, 1993, abandoned.

[30] Foreign Application Priority Data

Dec. 22, 1992 [DE] Germany ..... 42 43 544.7

[51] Int. Cl.[6] ..... F04D 29/04

[52] U.S. Cl. ..... 415/55.1

[58] Field of Search ..... 415/55.1, 55.3, 55.5, 415/170.1

[56] References Cited

U.S. PATENT DOCUMENTS

| | | | |
|---|---|---|---|
| 2,051,080 | 8/1936 | Frederick | 415/55.1 |
| 2,468,246 | 4/1949 | Thayer | 415/55.1 |
| 4,992,022 | 2/1991 | Aust et al. | 415/55.1 |
| 5,137,418 | 8/1992 | Sieghartner | 415/55.1 |
| 5,163,810 | 11/1992 | Smith | 415/55.1 |

*Primary Examiner*—John T. Kwon
*Attorney, Agent, or Firm*—Michael J. Striker

[57] ABSTRACT

A fuel pump has a pump housing, and a rotor rotatable in the pump housing and having an outer surface. The housing has an inner wall which faces the rotor and forms with the outer surface of the rotor a narrow gap. The inner wall is provided with a plurality of depressions which are independent from one another and form a sealing region.

3 Claims, 1 Drawing Sheet

FUEL PUMP

This is a continuation of application Ser. No. 08/136,686 filed Oct. 14, 1993.

BACKGROUND OF THE INVENTION

The present invention relates generally to fuel pumps.

More particularly, it relates to a fuel pump which has a pump housing and an impeller movable in the pump housing.

Fuel pumps of the above-mentioned general type are known in the art. Fuel pumps serve, for example, for supplying fuel to a gasifier in Otto motors and injection pumps of diesel motors. It is therefore conventional to form the fuel pump as a turbine pump since the fuel must be supplied under pressure because otherwise the filling of the pump cylinder is not guaranteed. The construction of the seals in turbo machines has the purpose of producing narrow gaps with a maximum possible throughflow resistance. The high speed of these machines prohibits surface contact between the housing and the rotor. It is also necessary to provide gaps through which a certain quantity of the fluid to be supplied can flow. The gaps, however, must be formed so that the quantity is as small as possible. The losses through the seals are therefore decisive for the possibility to use such a turbine pump.

SUMMARY OF THE INVENTION

Accordingly, it is an object of the present invention to provide a fuel pump which avoids the disadvantages of the prior art.

In keeping with these objects and with others which will become apparent hereinafter, one feature of the present invention resides, briefly stated, in a fuel pump which has a pump housing and an impeller movable on the housing, wherein an outer surface of the impeller forms with an inner wall of the housing a narrow gap, and the inner wall of the housing has depressions with respect to the impeller independent from one another and forming a sealing region.

When the fuel pump is designed in accordance with the present invention, a known turbine pump can be used as a fuel pump with the advantages of the turbine pump used in the fuel pump, and simultaneously the leakage is reduced and the pump efficiency is increased.

While in the inventive pump the leakage flow in the pump part is reduced and therefore the pump part efficiency is increased, the efficiency is obtained without additional machining expenses, such as narrow tolerances, mating, etc. Also, in the inventive fuel pump, there are improved heat conveying conditions.

In accordance with another feature of the present invention, it is advantageous when the depressions are point-like. In other words, it is advantageous when the closing surfaces of the depressions have a small diameter.

In accordance with still another advantageous feature of the present invention, the depressions can be formed as grooves. It is advantageous when the grooves extend along the lines of approximately the same pressure, or in other words, along the isobars.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
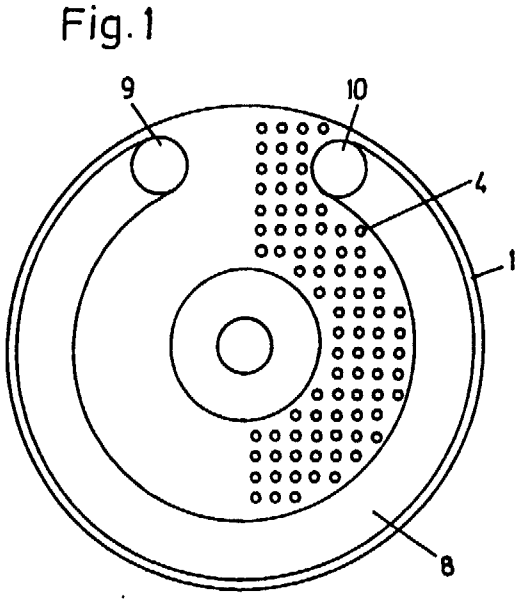
FIG. 1 is a schematic plan view of a fuel pump in accordance with the present invention.
Figure 2:
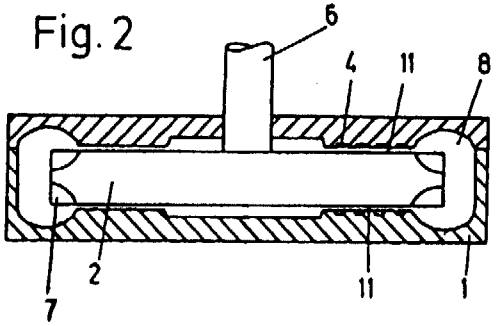
FIG. 2 is a view showing a horizontal section of the inventive fuel pump of FIG. 1.

Starting first from the first embodiment of the present invention, it can be seen that a fuel pump in accordance with the invention shown in FIGS. 1 and 2 has a housing which is identified as a whole by reference numeral 1. An impeller or rotor 2 is rotatably supported in the housing 1 and turnable for example via a shaft 6.

The housing 1 has an inner wall which faces the impeller 2. This inner wall is provided with a plurality of depressions 4 which are arranged at certain distances from one another and separated from one another by the material of the wall. The depressions 4 are open toward an interior of the housing and toward the impeller. As can be seen from FIG. 1, practically the whole inner wall of the housing 2 which is opposite to the impeller 2 is provided with the depressions 4. The wall of the housing which has the above-mentioned depressions extends substantially perpendicular to the axis of the impeller. As can be seen from the drawings, both inner walls of the housing 1 which are located at opposite axial sides of the impeller and face toward the impeller, are provided with the depressions 4.

The housing further has an inlet 9 and an outlet 10. A passage 8 extends from the inlet 9 to the outlet 10 along a circumference of the impeller 2 inside the housing 1. A substance to be supplied by the pump is under a relatively low pressure in the region of the inlet 9 and at a relatively high pressure in the region of the outlet 10.

A narrow gap 11 is formed between projections or knobs of the inner wall of the housing 1 and the impeller 2. Since simultaneously the surface tension of the medium to be supplied is produced, the adherence of the medium in the gap increases and therefore the sealing is improved.

Figure 3:
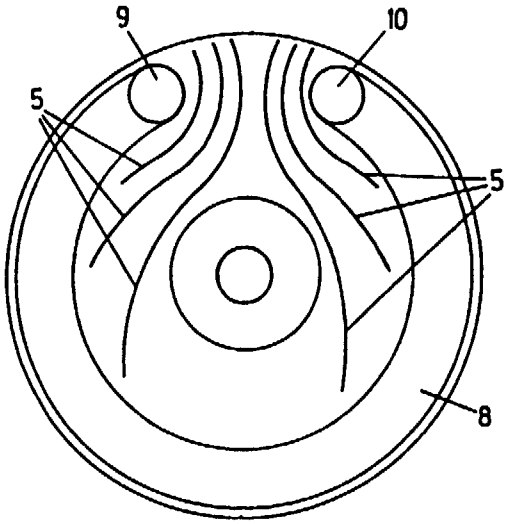
FIG. 3 is a view substantially corresponding to the view of FIG. 1 but showing a further embodiment of the fuel pump in accordance with the present invention.
Figure 4:
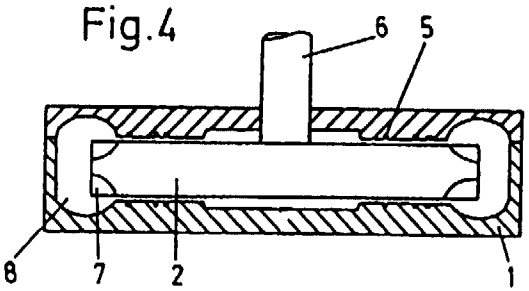
FIG. 4 is a view showing a horizontal section of the fuel pump of FIG. 3.

In the fuel pump in accordance with another embodiment shown in FIGS. 3 and 4, the inner surfaces of the housing which face the impeller 2 are also provided with a plurality of depressions. However, in this embodiment, the depressions are formed as grooves 5. In this embodiment the grooves extend preferably along the lines of identical pressure or in other words along the isobars. As can be seen from FIG. 3, the grooves 5 are also located symmetrically relative to the shaft 6 or relative to a transverse axis of the impeller 2.

Figure 5:
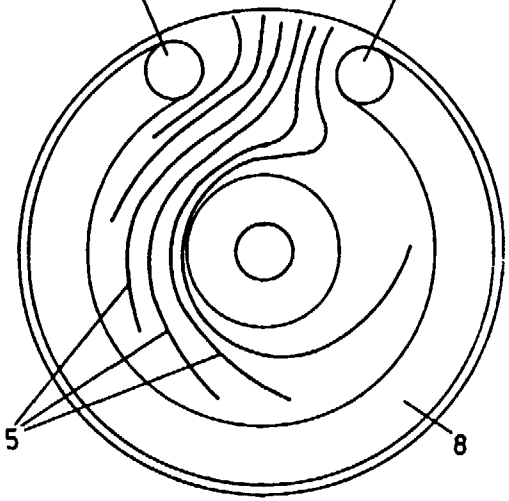
FIG. 5 is a view showing still a further embodiment of the fuel pump in accordance with the present invention.
Figure 6:
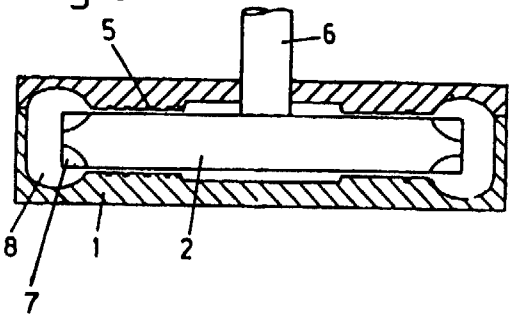
FIG. 6 is a view showing a horizontal section of the fuel pump of FIG. 5.

In the embodiment shown in FIGS. 5 and 6, the depressions are also formed as grooves 5'. However, in this embodiment, the grooves 5' are not symmetrical relative to the shaft 6 or relative to a transverse axis of the impeller 2. Instead, they extend mainly at one side of the shaft 6 and partially around the shaft.

When the fuel pump is designed in accordance with the present invention, it provides conditions which are similar to conditions existing in labyrinth seals.

It will be understood that each of the elements described above, or two or more together, may also find a useful application in other types of constructions differing from the types described above.

While the invention has been illustrated and described as embodied in a fuel pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fuel pump, comprising a pump housing; and a rotor rotatable in said pump housing and having an outer surface, said housing having an inner wall facing said rotor and forming with said outer surface of said rotor a narrow gap, said inner wall being provided with a plurality of depressions which are independent from one another and form a sealing region, said rotor having a transverse axis, said grooves extending substantially in direction of said transverse axis and symmetrically relative to said transverse axis of said rotor.

2. A fuel pump as defined in claim 1, wherein said grooves extend along lines with approximately identical pressures.

3. A fuel pump, comprising a pump housing; and a rotor rotatable in said pump housing and having an outer surface, said housing having an inner wall facing said rotor and forming with said outer surface of said rotor a narrow gap, said inner wall being provided with a plurality of depressions which are independent from one another and form a sealing region, said depressions being formed as elongated grooves, said rotor having a transverse axis, said grooves extending substantially asymmetrically relative to said transverse axis of said rotor.

* * * * *